US005598958A

United States Patent [19]

Ryan, III et al.

[11] Patent Number: 5,598,958

[45] Date of Patent: Feb. 4, 1997

[54] COMPETITION HOLSTERS

[76] Inventors: Willis N. Ryan, III, 40790 Hwy. 49, Oakhurst, Calif. 93644; Kerby C. Smith, 42827 Bean Gulch Ranch Rd., Coarsegold, Calif. 93614

[21] Appl. No.: 304,589

[22] Filed: Sep. 12, 1994

[51] Int. Cl.[6] ..... F41C 33/02

[52] U.S. Cl. ..... 224/198; 224/912; 224/192; 224/193; 224/242; 224/243; 224/244; 224/672; 224/673; 224/674; 224/678

[58] Field of Search ..... 224/198, 911, 224/912, 192, 193, 242, 243, 244, 245, 253, 224, 225, 226

[56] References Cited

U.S. PATENT DOCUMENTS

| | | | |
|---|---|---|---|
| 3,866,811 | 2/1975 | Hamby . | |
| 5,167,355 | 12/1992 | Hill | 224/193 |
| 5,284,281 | 2/1994 | Nichols | 224/244 |
| 5,372,288 | 12/1994 | Rogers et al. | 224/912 |
| 5,419,472 | 5/1995 | Hellweg et al. | 224/198 |
| 5,419,474 | 5/1995 | Marx et al. | 224/244 |

*Primary Examiner*—Renee S. Luebke
*Assistant Examiner*—Timothy P. Maust
*Attorney, Agent, or Firm*—Wagner & Middlebrook

[57] ABSTRACT

Competition holsters for use with autoloading pistol and revolver handguns. They include a protrusion with a trigger guard recess and a trigger guard retainer which is cantilevered from the outside of the body into the trigger guard at a compound angle to hold the handgun in the holster. The frame of the handgun extends over an elongated surface at the top of the body. The handgun is, in actuality supported on a cradle at the muzzle region and on the lower side of the trigger guard. A muzzle tensioner in the form of an inverted J is adjustable secured to the body in the muzzle region. A belt loop assembly including mating partial spherical surfaces secures the body for universal spherical angular adjustment. Further adjustments include the compressive force on the trigger guard retainer. All of the adjustments may be made with the holster in place on the shooter's gun belt.

32 Claims, 8 Drawing Sheets

FIG. 9
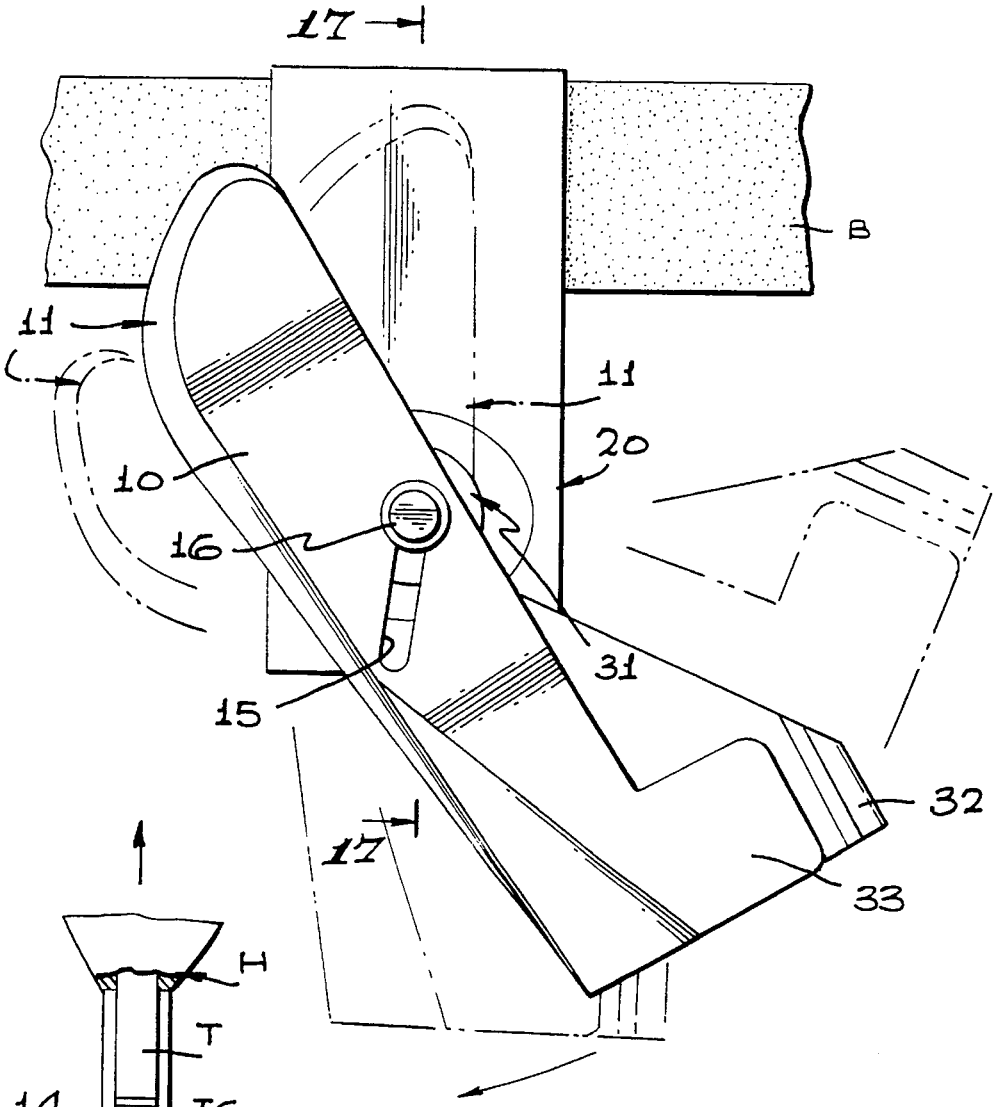
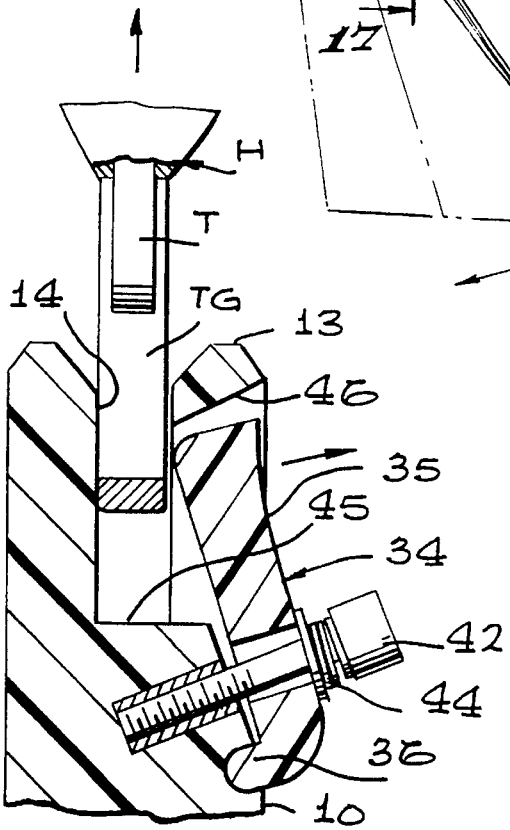
FIG. 19

FIG. 7A
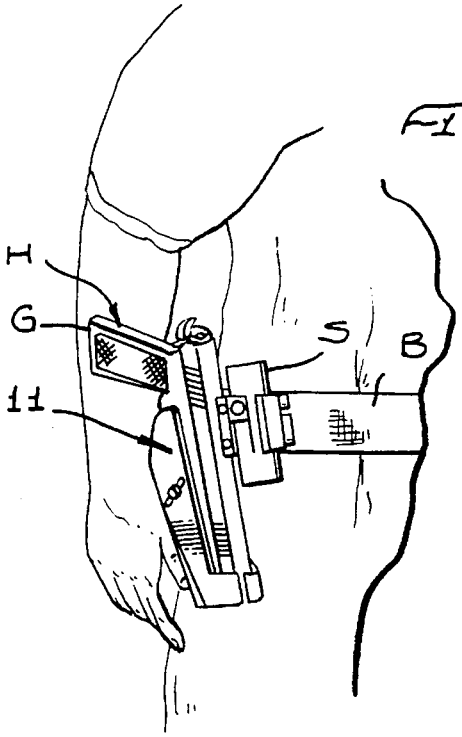
FIG. 7B
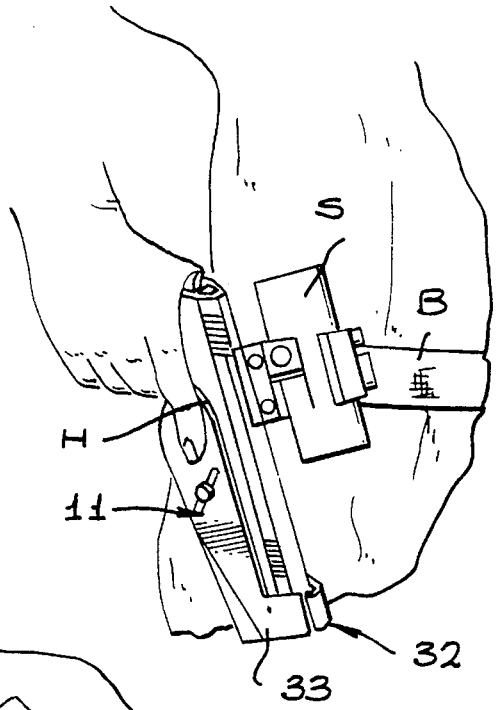
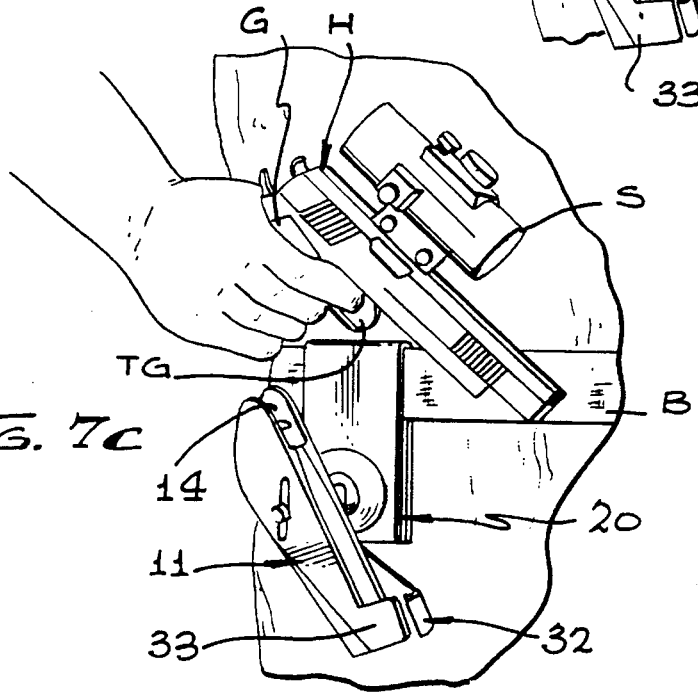
FIG. 7C

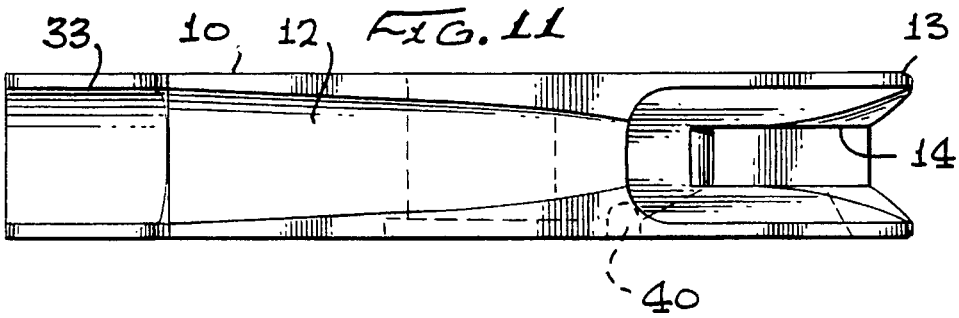
FIG. 11
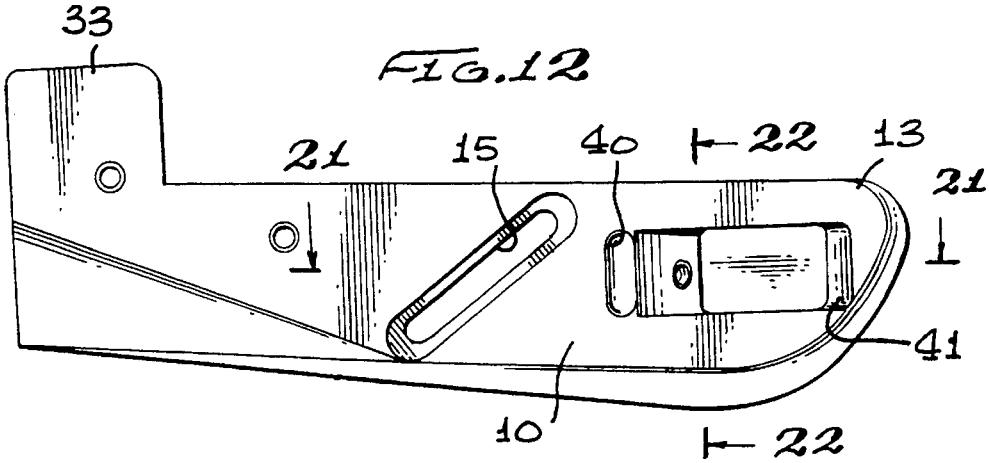
FIG. 12
FIG. 13
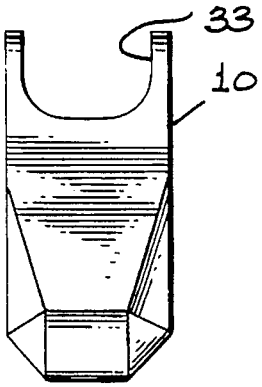
FIG. 14
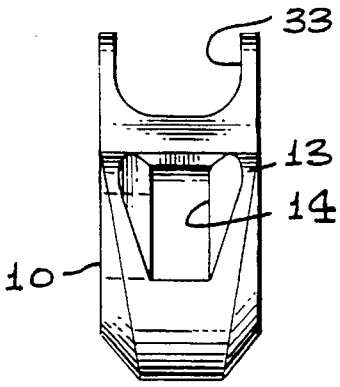
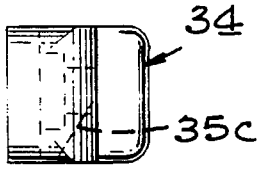
FIG. 15C
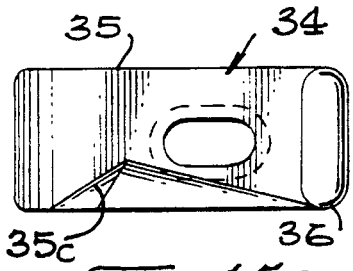
FIG. 15D
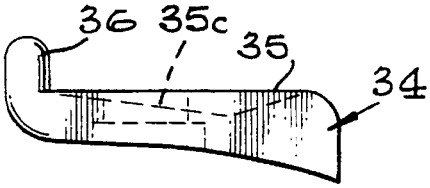
FIG. 15A
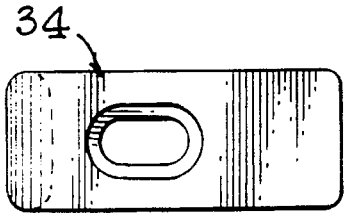
FIG. 15B FIG. 16
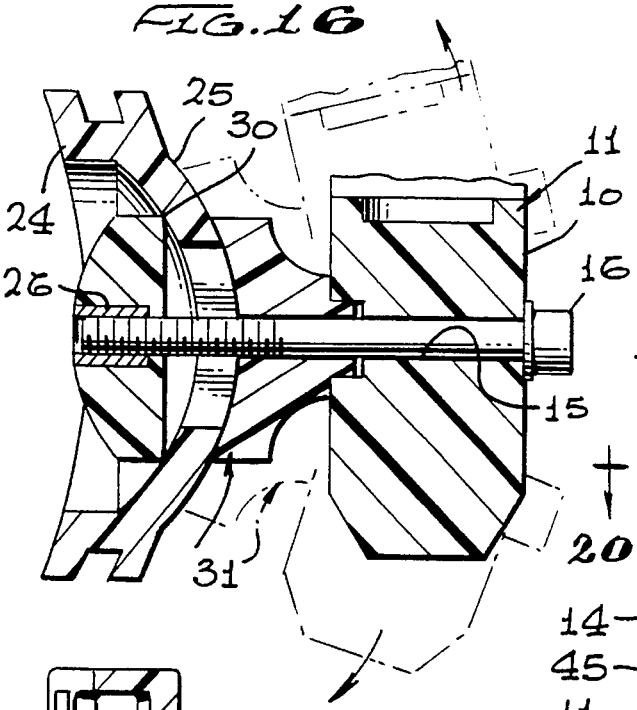
FIG. 18
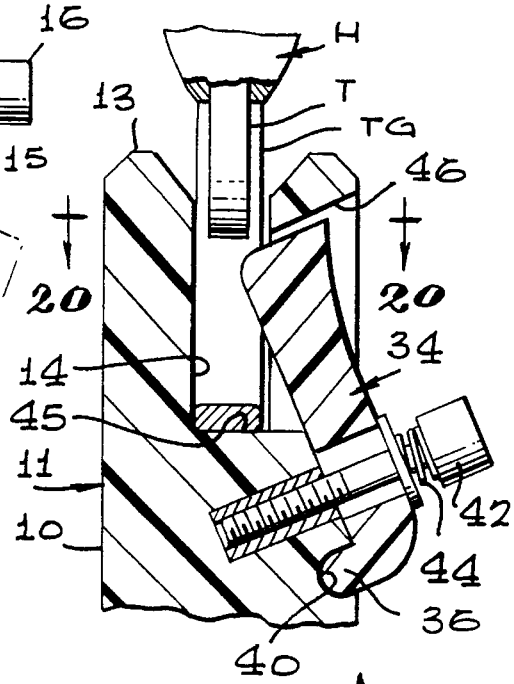
FIG. 17
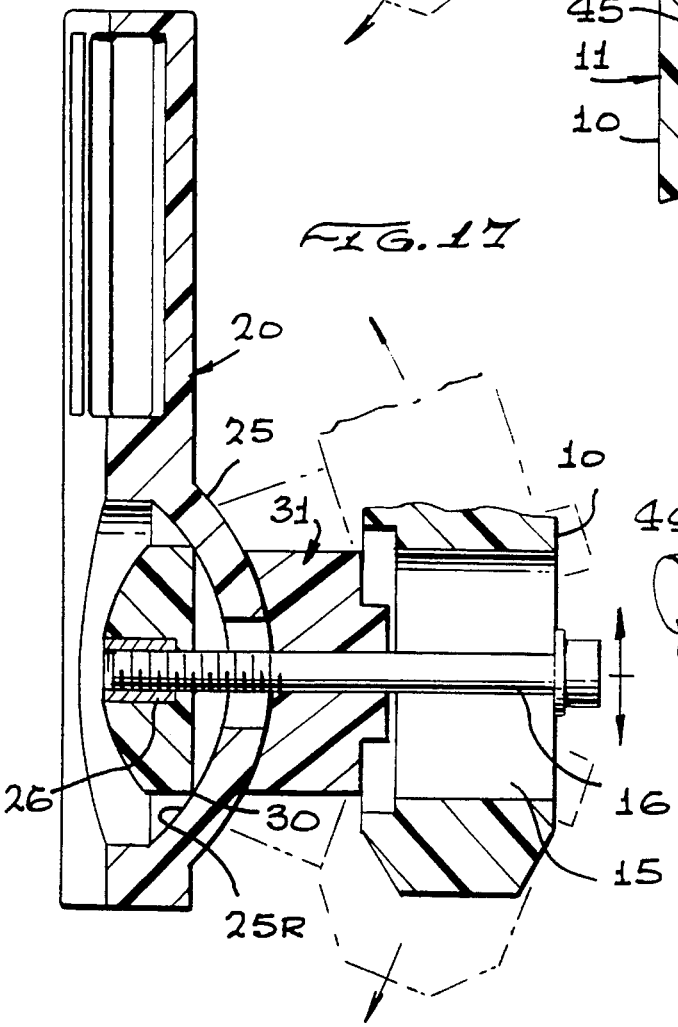
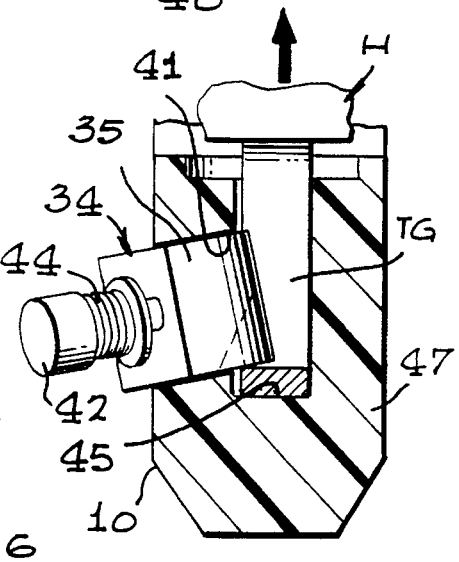
FIG. 20

FIG. 21
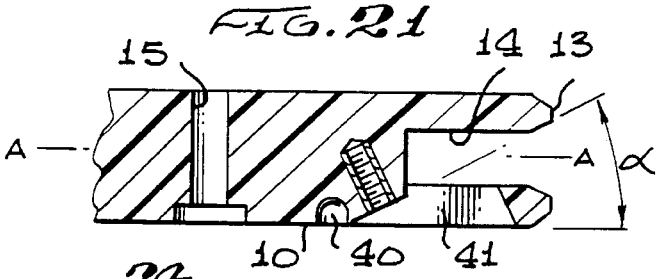
FIG. 22
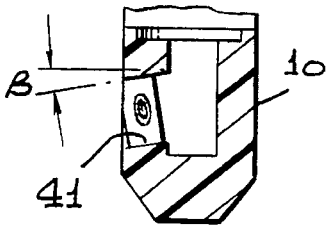
FIG. 23
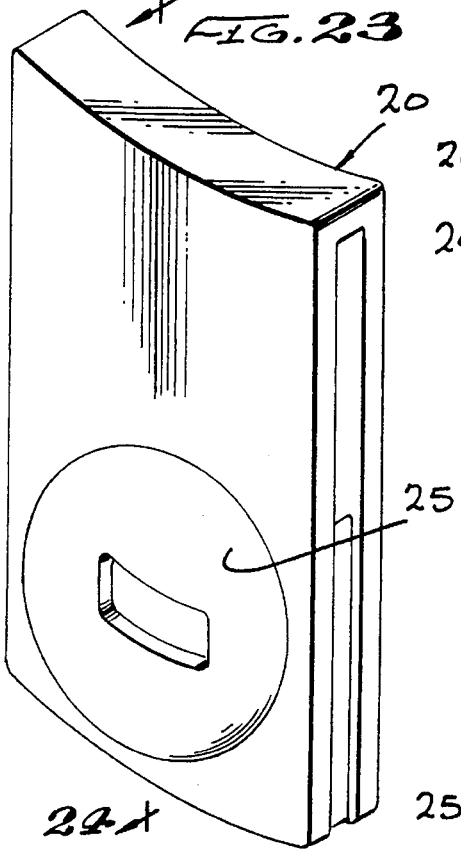
FIG. 24
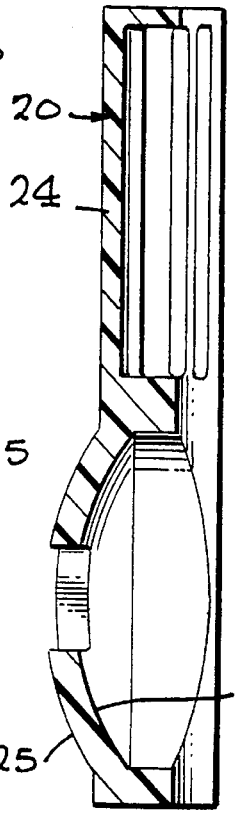
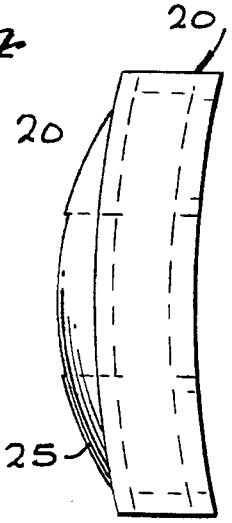
FIG. 25
FIG. 27B
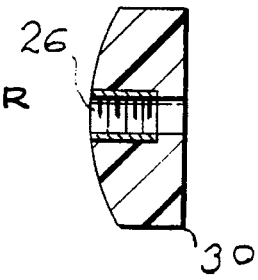
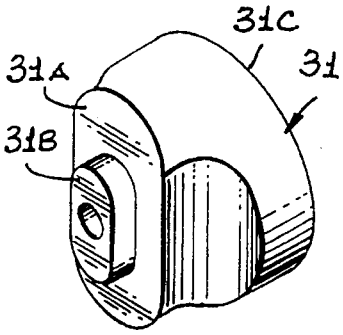
FIG. 26A
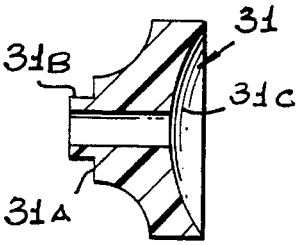
FIG. 26B
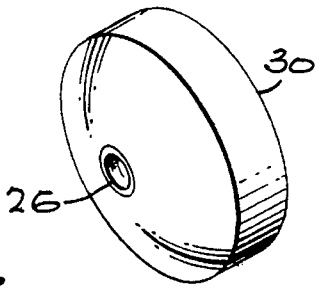
FIG. 27A FIG. 28
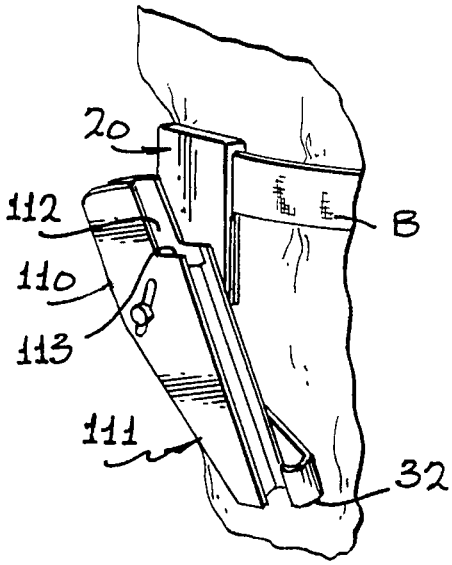
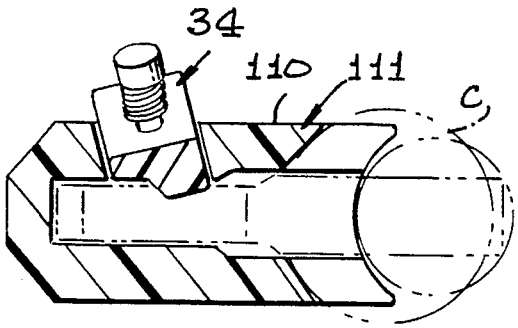
FIG. 30
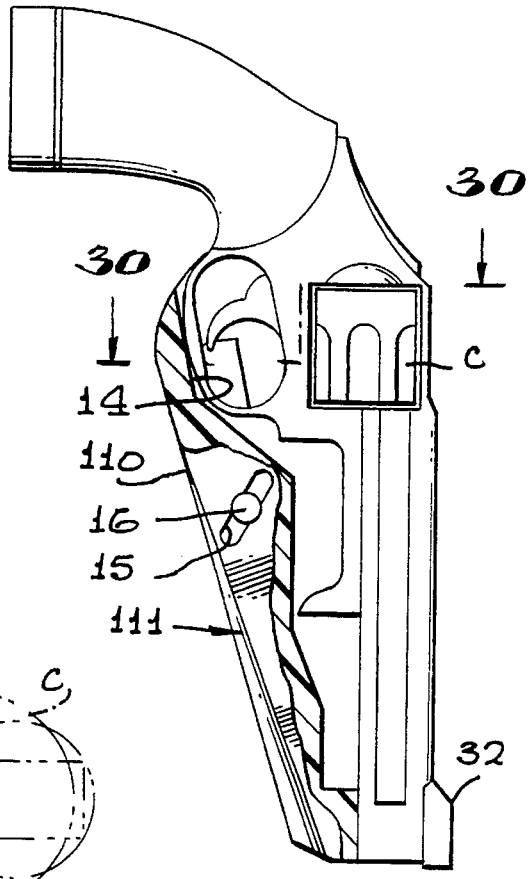
FIG. 29
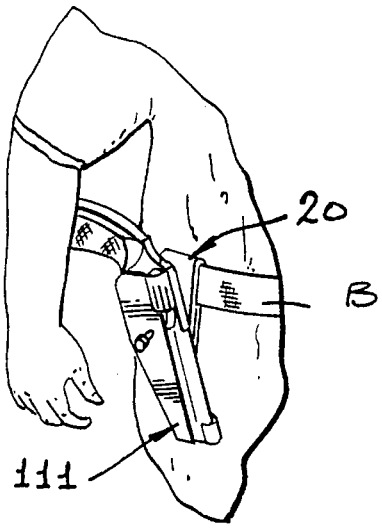
FIG. 31A
FIG. 31B
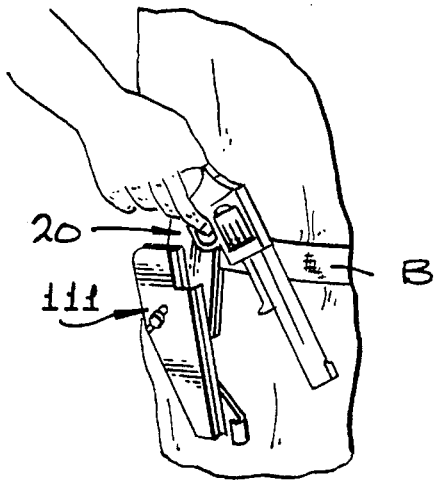

COMPETITION HOLSTERS

BACKGROUND OF THE INVENTION

In the field of competitive handgun shooting, the normal requirements for eligibility to compete include the use of a holster which safely carries the shooter's handgun throughout all phases of the shooting routine. Any dropping of a handgun or unsafe practice or any unintended dislodgment of the handgun from its holster or carrier can result in immediate disqualification. Therefore, the need exists for an effective holster with secure strapping or retention. Most conventional holsters as designed to meet that requirement cannot be used in competition shooting for a variety of reasons. The first and most important reason is that most competition handguns have unique designed barrels, frames or grips as the shooter prefers for improved accuracy. Therefore conventional holsters would necessarily be redesigned or modified to meet the shooter's requirements. Likewise, speed of drawing and non interference are important factors is a shooter's performance and conventional holsters are not usually designed with that in mind, particularly for an unusual designed handgun.

The result is that a number of specialized competition holsters have been designed for various shooters. Most are one of a kind, and built under the scrutiny of the intended shooter. So far, we are not aware of anyone being able to design a competition type holster which is capable of reliably carrying most competition handguns regardless of their design and to carry the handgun at any rake angle, height or waist placement the shooter desires. Likewise, we are unaware of a competition holster which can be modified on the spot to meet any change in positioning performed by the shooter with a single adjustment.

BRIEF DESCRIPTION OF THE INVENTION

Faced with the foregoing state of the art, we determined that the required functions of the holster are:

1. To provide a secure attachment to a belt which is stable yet freely adjustable by the shooter to meet his particular desires or requirements;

2. To provide a holder for the frame of the handgun which precisely positions the grip for unobstructed grasping and non interference in the drawing mode;

3. To provide some effective lock which holds the handgun in the holder against unintended dislodgment under all types of movement of the shooter including jumping over obstructions;

4. To provide some type of muzzle restraint which cooperates with the lock in holding the handgun in place but does not interfere with drawing and further is adjustable to accommodate barrels of various shapes and lengths;

Although these requirements may seem simple, in achieving them for any single dedicated holster is extremely difficult and to make a nearly universal competition holster defies conventional holster design.

By attacking each of these requirements separately and then by integrating them into a single relatively simple design we believe that we have achieved such universality. We have found that it is possible to design such a universal holster and the only accommodation made in the holster for either autoloading pistols or revolvers is the substitution of one different part, that is truly the test of universality.

We paid particular attention to the belt loop assembly which is often overlooked as a critical part of any holster but particularly a competition holster. Belt loops are usually a folded over wide strap of leather, fabric, composite or molded part with a fixed connection to the holster body. Adjustment of the belt loop is usually limited to its longitudinal position on the wearer's belt although some belt loops provide for limited angular adjustment of the holster body on the belt loop. Any sliding or tipping of the belt loop on the belt results in an unwanted movement of the position of the handgun. Angular tipping of the belt loop is amplified at the handgun and, in effect, produces instability of the handgun if it can rock forward and backward as the belt loop tips on the belt.

We have also discovered that the most effective method of supporting a competition handgun in place is in a rigid body and that through the use of a cantilevered lock which engages the trigger guard in a compound angle under controllable pressure produces a truly effective lock with instant release by the shooter in his preferred draw sequence.

Recognizing that competition handgun barrels have many lengths and sizes, we have designed a muzzle tensioner of a generally inverted J shape and adjustable in two axes to hold a majority of competition handgun regardless of its size or barrel length.

BRIEF DESCRIPTION OF THE DRAWING

This invention may be more clearly understood from the following detailed description and by reference to the drawing in which:

FIG. 4 is a side elevational view of the holster of FIG. 1 showing both the vertical and angular degrees of adjustment of the holster on the belt loop;

FIGS. 7A, 7B and 7C are a sequence of drawings showing the preferred handgun drawing routine for the holster of FIG. 1;

FIG. 11 is a top plan view of the body of the holster of FIG. 1;

FIG. 12 is an inner side elevational view of the body of FIG. 11;

FIG. 13 is a rear elevational view of the body of FIG. 11;

FIG. 14 is a front elevational view of the body of FIG. 11;

FIGS. 15A, 15B, 15C and 15D are side elevational, top plan, left end and bottom plan views, respectively of the trigger guard retainer of this invention;

FIG. 16 is a horizontal sectional view of the holster body-belt loop assembly interface taken along line 16—16 of FIG. 3;

FIG. 17 is a vertical sectional view of the holster body belt loop assembly interface taken along lines 17—17 of FIG. 4;

FIG. 18 is a horizontal sectional view of the trigger guard lock details taken along lines 18—18 of FIG. 3;

FIG. 19 is a horizontal sectional view of the trigger guard lock details similar to FIG. 18 with the handgun partially withdrawn from the holster;

FIG. 20 is a vertical sectional view of the trigger guard lock details taken along lines 20—20 of FIG. 18;

FIGS. 21 and 22 are fragmentary horizontal and vertical sectional views, respectively, of the holster body similar to FIGS. 18 and 20 showing the compound angles of the mount for the trigger guard lock;

FIG. 23 is a perspective view of the belt loop assembly of FIGS. 1 and 2;

FIG. 24 is a vertical sectional view of the belt loop member taken along lines 24—24 of FIG. 23;

FIG. 25 is a top plan view of the belt loop member of FIG. 23;

FIGS. 26A and 26B are perspective and horizontal diametrical sectional views, respectively, of the spacer of the belt loop assembly of FIGS. 2, 3 and 8;

FIGS. 27A and 27B are perspective and diametrical sectional views, respectively, of the partial spherical shaped captive nut of the belt loop assembly of FIG. 8;

FIG. 28 is a perspective view of the revolver version of this invention;

FIG. 29 is a vertical sectional view of the revolver holster of FIG. 28 with a competition revolver in place;

FIG. 30 is a horizontal sectional view of the revolver version holster of FIGS. 28 and 29, taken along line 30—30 of FIG. 29;

FIGS. 31A and 31B are perspective views of a competition shooter drawing a revolver from the holster of FIG. 28.

DETAILED DESCRIPTION OF THE INVENTION

Figure 1:
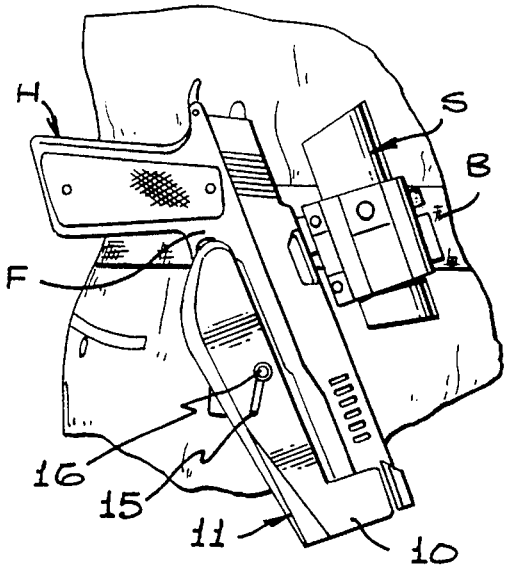
FIG. 1 is a side elevational view of a competition shooter with the holster of this invention carrying an auto loading pistol with a sight attachment.

For an understanding of this competition holster or handgun carrier, to be more precise, reference is now made to FIGS. 1–4 wherein a handgun H with its sight S is supported on the body 10 of holster 11 with the frame F of the handgun H resting on a surface 12 which is interrupted at its rear or upper end 13 by a trigger guard recess 14. The body 10 is of relatively rigid material such as aluminum or the polymer known by the trademark Delrin of the dupont Company of Wilmington, Del. or other material of sufficient strength and durability to hold a fully loaded handgun.

Figure 2:
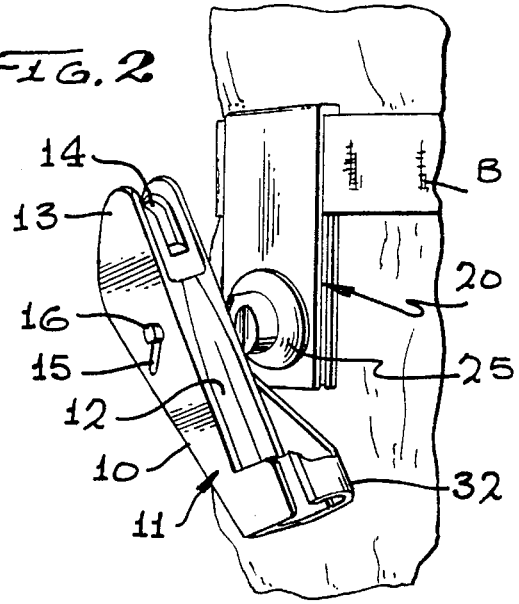
FIG. 2 is a perspective view of the holster of FIG. 1 with the handgun removed.
Figure 3:
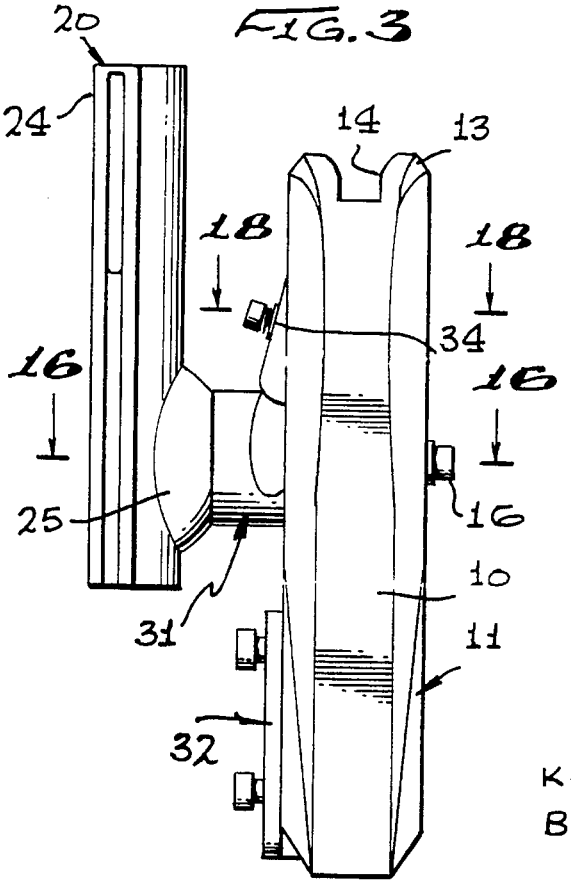
FIG. 3 is front elevational view of the competition holster of FIG. 1.

The outer face of the body 10 includes an elongated slot 15 which allows upward and downward adjustment of the body with respect to the holsters belt loop assembly 20 of FIGS. 2–4 by loosening, moving the body 10 and tightening adjusting screw 16. As may be seen in FIGS. 2 and 3, the adjustment screw 16 extends inward directly on the centerline of the connection to the belt loop assembly 20 and along a common radial axis of the partial spherical surfaces 25 and 31C, described below. The adjusting screw 16 also acts as a locking device for the holster body 10 to the beltloop assembly 20 after all adjustments are made. This single adjustment allows not only the up/down adjustment of the holster body 10 on the belt loop assembly 20 but its pivotal angle adjustment shown in FIG. 4 and the forward and rearward angle of the holster 11 with respect to the shooter's body as may be visualized in FIG. 2. In fact, the angle of adjustment of the holster body 10 with respect to the belt loop is adjustable over a spherical angle with infinite angle adjustment within the range as is described below.

In FIG. 3, it may be noted that there is significant clearance between the belt loop assembly 20 and the body 10 to insure good hand clearance and it should also be noted that the handgun H grip G and hammer M are fully exposed while the trigger and trigger guard are fully covered while the handgun H is holstered. This is shown in FIG. 1. The clearance between the belt loop member 24 and the body 10 is provided by the spacer 31 which appears in FIGS. 2, 3 and 8. This spacer 31 includes a generally cylindrical length which may be varied depending upon the total spacing desired by the shooter and tournament regulations. It includes a planar end surface 31A with a tenon 31B at one end and concave surface 31C at the opposite end and shaped to engage the convex surface 25 of the belt loop member 24 for angular adjustment. The tenon 31B is dimensioned to have a width which is nearly as wide as the slot 15 and a length less than that of the slot 15. The holster body 10 may slide along the surface 31A to the limits of linear adjustment determined by tenon 31B.

Figure 5:
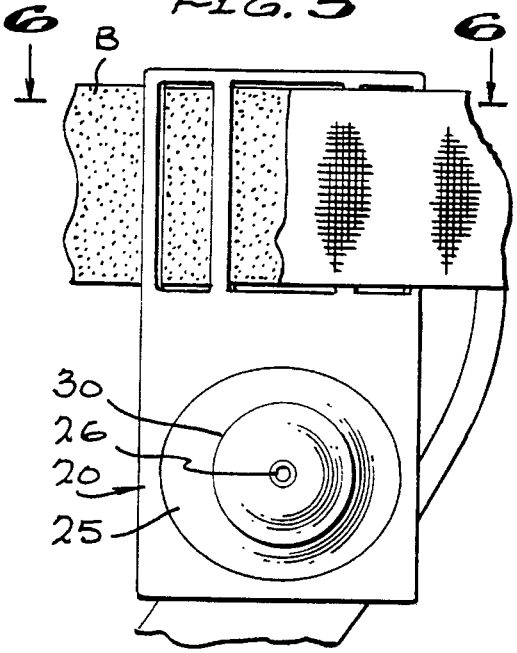
FIG. 5 is a side elevational view of the belt loop assembly of the holster of FIG. 1.
Figure 6:
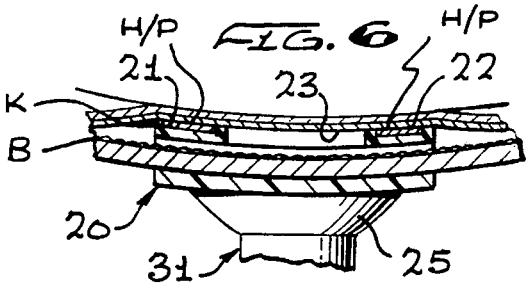
FIG. 6 is a horizontal sectional view of the belt loop assembly of FIG. 5 taken along line 6—6 of FIG. 5.
Figure 8:
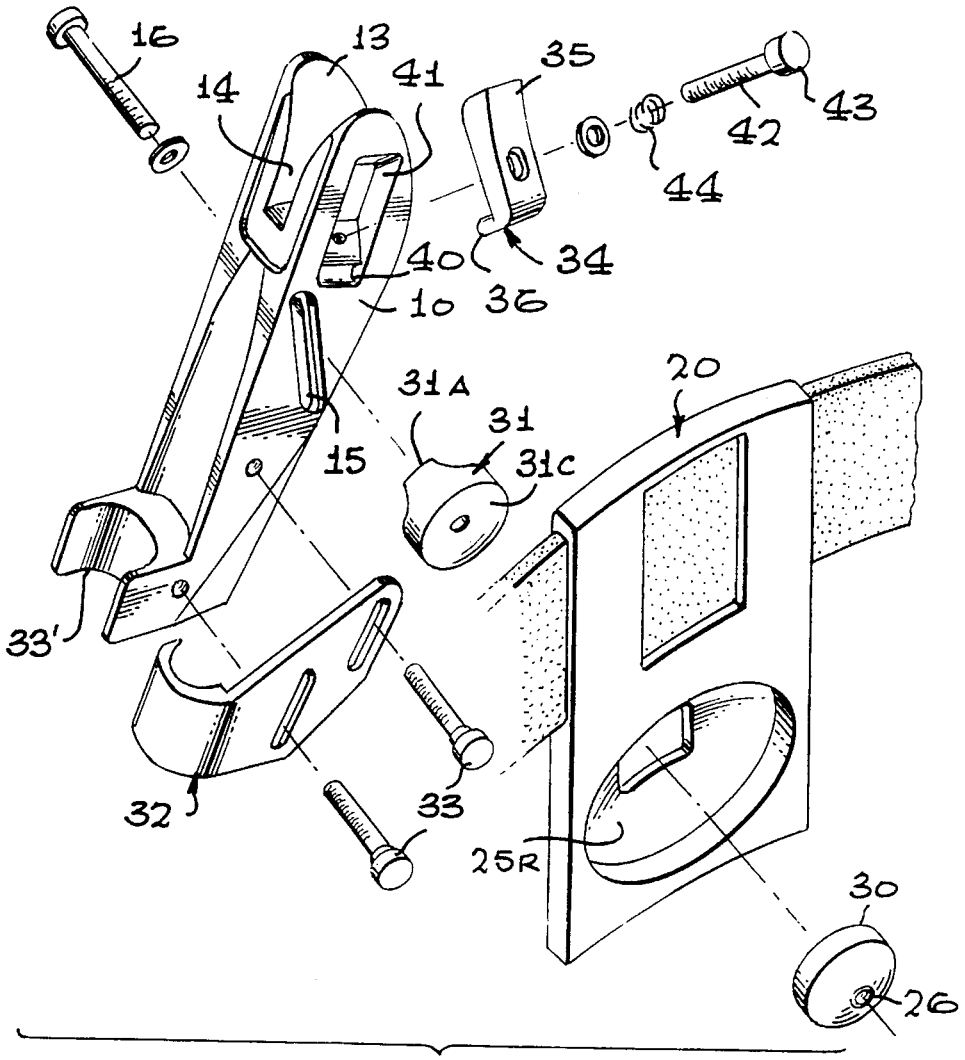
FIG. 8 is an exploded view of the holster of FIG. 1.

Referring now to FIGS. 5 and 6, which show the mounting of the belt loop assembly 20 on the wearer's belt B as seen from the inside of belt B in FIG. 5. Two areas of hook or pile H/P fabric are found in recesses 21 and 22 which lie on either side of an opening 23. The two areas of hook or pile fabric fastener H/P are used for engaging the mating H/P fabric on the adjacent side of keeper K which also engages mating hook or pile fabric fastener H/P in the inner face of the belt B on either side of the belt loop assembly 20 and through the opening 23. This arrangement secures the belt loop assembly to the keeper K and the keeper K to the belt B for precise longitudinal positioning of the belt loop assembly 20 on the belt at the exact position desired by the shooter. The belt loop member 24 may be seen in FIG. 6 to be a slightly curved plate with a belt slot through it and a convex, partial spherical section 25 toward the bottom of its outer face. On the inner face, shown in FIGS. 5 and 8 is a concentric partial spherical surface 25R and a captured nut 26 in a nut housing having a rim 30 which contacts the rear surface 25R of the surface 25, best seen in FIGS. 27A and 27B. Surfaces 25 and 25R are a convexo-concave partial sphere set. The concave surface 25R may have a radius equal to or less than the radius of the convex surface 25R. The convex and concave surfaces may be located on either of the mating members. A spacer 31 may be seen in FIGS. 3 and 6 and in parts detail in FIGS. 26A and 26B. This spacer 31 determines the spacing between the belt loop assembly 20 and the holster body 10. This spacing is often regulated by tournament rules so the holster may be adjusted in spacing merely by changing the spacer 31 and possibly the length of adjusting screw 16.

Figure 9:
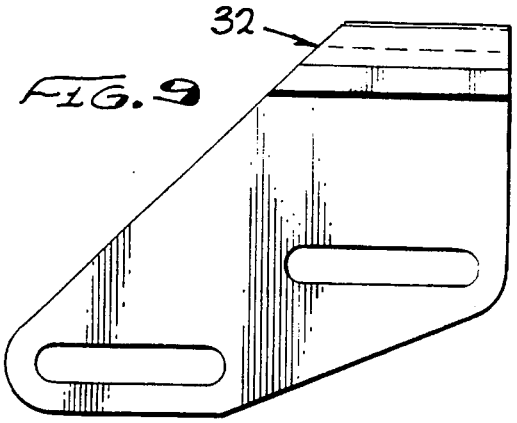
FIG. 9 is a side elevational view of the muzzle tensioner of the holster of FIG. 1.
Figure 10:
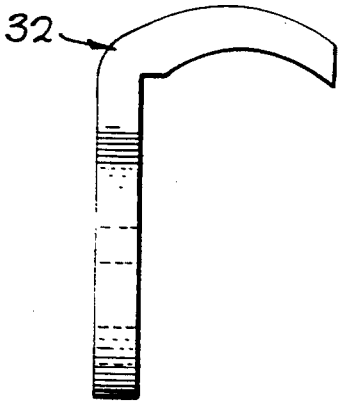
FIG. 10 is a front elevational view of the muzzle tensioner of FIG. 9.

Referring now to FIGS. 8–10, all of the component parts of the holster or handgun carrier 11 may be seen in their relative positions ready for assembly. From this view, it is apparent that this handgun carrier has little of the normal appearance of a holster which usually covers most of the handgun with the exception of the grip. In this case, the frame is carefully cradled in its support surface 12 and the trigger and trigger guard are concealed within the trigger guard recess 14. Additionally, the muzzle tensioner 32 is shown exploded from the body 10. The muzzle tensioner 32 is adjustable by loosening its screws 33 and sliding the tensioner for a distance to secure the muzzle of the handgun. The barrel or the frame of the handgun H are located in a cradle 33 at the extreme front of the body 10 and are protected by the cradle 33 and the muzzle tensioner 32 from unwanted release.

During the drawing sequence which is illustrated in FIG. 7, the handgun grip G is grasped, the trigger T and trigger guard TG raised out of the recess 14 against the resistance of the trigger guard retainer 34 of FIGS. 3, 8 and 18–20. Next the handgun is pivoted upward and drawn out of the cradle 33 and muzzle tensioner 32 ready for aiming and firing.

The muzzle tensioner 32 is shaped to receive virtually any shaped frame or barrel and hold it securely. The rear edge of the hook portion is used for pivoting the muzzle for removal. Since many competition handguns do not include a fixed front sight, it need not be grooved for passage of a front sight during drawing. A sight groove may be added to the muzzle tensioner 32 for use with front sighted handguns. The muzzle tensioner, in contrast with prior muzzle restrainers is infinitely adjustable within its travel range in two directions, both in the forward/rearward direction and upward and downward making this device virtually universal for competition handguns. The upward and downward adjustment of the muzzle tensioner 32 is accomplished by utilizing the slot width clearance.

The trigger guard retainer 34 as seen in FIG. 8, 15 and 18–20 includes a locking bar 35 having a circular cross section protrusion 36 which rests in a mating recess 40 within a side recess 41 in the body 10. The locking bar 35 pivots within the side recess 41 to extend into the trigger guard recess 14 as best seen in FIG. 18. The trigger guard retainer 34 also includes tension adjusting screw 42 with knurled finger grip 43 and a compression spring 44. FIG. 18 shows the locking bar 35 in its normal position with a handgun H holstered and the trigger guard TG resting on the front wall 45 of the trigger guard recess 14 and the locking bar entering the trigger guard TG ahead of the trigger T. Note that the side recess includes an end wall 46 which is spaced from the front wall 45 of the trigger guard recess 14 less than the minimum finger opening of any competition handgun with which we are familiar so that the locking bar 35 can never contact the trigger, an important safety feature. During the first stage of drawing the handgun H as shown in FIG. 19, the locking bar 35 is pivoted out of the trigger guard recess 14 to allow the trigger guard to be released and the handgun drawn. The locking bar pivots about the protrusion 36 against the compression spring 44. The tension adjusting screw 42 extends out of the inner side of the body 10 for ease of adjustment at any time by the shooter. This adjustment may be made while the holster is being worn, an important feature.

FIGS. 21 and 22 illustrate the compound angle of movement of the locking bar 35 in locking and unlocking the trigger guard TG. In FIG. 21, the angle alpha, the full entrance angle of the locking bar in the side recess 41 varies between 15 and 40 degrees as measured from the axis A-A defined by the bore of the handgun H or measured in a plane generally parallel to the upper surface of the body 10. The preferred value of the angle alpha is 25 degrees. The second angle, beta, which is the angle of the entrance of the locking bar 35 measured in a plane generally normal to the axis A—A and normal to the length of body 10. The useful range of values for angle beta is 5 to 15 degrees with the preferred value of the angle beta to be 10 degrees.

By utilizing a body with substantial thickness and a material of dimensional stability, precise positioning and angles of entrance of the locking bar into the trigger guard recess is possible.

As designed, forces applied to the bottom of the grip of a holstered handgun wedge the locking bar 35 against the surface 46 of body 10 as shown in FIG. 20 and the handgun may not be removed in that direction.

Forces applied to the locking bar 35 in normal lifting movement causes the trigger guard TG to move along the contoured surface 35C of locking bar 35 for a smooth quick draw. The arrows in FIGS. 19 and 20 illustrate the difference in the amount of force required to dislodge the handgun in the normal direction (FIG. 19) as compared to the unintended direction (FIG. 20).

The embodiment shown in FIGS. 1–27 includes all of the necessary elements to fit virtually any reasonable design competition auto loading pistol. It also allows for full angular adjustment of the holster body 10 with respect to the belt loop and vertical adjustment as well. The resistance to draw and the position of the muzzle protrusion point about the muzzle tensioner is adjustable as well. All of these adjustments may be made while the holster is in place on the shooter's gun belt. There is no need to remove the gun belt, remove the belt loop from the gun belt, make an adjustment, reassemble the holster on the gun belt, redon the gun belt and then see how it feels before repeating the sequence until the shooter is satisfied. With this competition holster, the shooter merely places the belt loop on the gun belt, dons the belt, adjusts the belt loop position on the hip, as desired, and then makes the angle, height and tension adjustments by loosening operated screws, making the adjustments, and retightening the screws.

The simplicity and effectiveness of this design of holster is not limited to auto loading pistols as is illustrated in FIGS. 28 through 31. Only the body 110 is substituted for the body 10 of FIGS. 1–27. All other parts are directly usable in the revolver carrier, generally designated 111. For certain revolvers, a different muzzle tensioner 32 may be desired. The only differences in the body 110 as compared with the body 10 are the somewhat deeper trigger guard recess, and lower positioning of the trigger guard retainer 34, both shown in FIGS. 29 and 30 and a cutout 112 for the revolver cylinder C which is clearly visible in FIGS. 28–31.

One major difference in the body 110 as compared with the body 10 is that, the stop surface used is wall 113 as seen in FIGS. 28 and 31A. For that reason, the trigger guard retainer 32 is located with respect to the surface 113.

The drawing sequence shown in FIGS. 31A and 3lB is virtually the same as the sequence for the auto loading pistol as illustrated in FIGS. 7A–7C.

The above described embodiments of the present invention are merely descriptive of its principles and are not to be considered limiting. The scope of the present invention instead shall be determined from the scope of the following claims including their equivalents.

What is claimed is:

1. A handgun carrier to be worn on the belt of a wearer comprising:

a belt loop assembly;

a handgun holder secured to said belt loop assembly;

said belt loop assembly including means defining a belt loop dimensioned to receive a waist worn belt to suspend the handgun carrier and a handgun holder attachment means;

said handgun holder attachment means including a first partial spherical surface and a second partial spherical surface mating with said first partial spherical surface;

one of said surfaces secured to said belt loop assembly and the other of said surface secured to said handgun holder; and adjustable means for engaging said first and second partial spherical surfaces for spherical angular adjustment between the belt loop assembly and the handgun holder.

2. A handgun carrier in accordance with claim 1 wherein said adjustable means for engaging said first and second partial spherical surfaces comprises a locking member extending axial to the centers of both of said first and second partial spherical surfaces.

3. A handgun carrier in accordance with claim 2 wherein at least one of said partial spherical surfaces includes an opening therethrough allowing spherical angular adjustment of said locking member and the handgun holder with respect to said belt loop assembly.

4. A handgun carrier in accordance with claim 2 wherein said locking member comprises a screw and nut.

5. A handgun carrier in accordance with claim 1 wherein said belt loop assembly comprises an elongated relatively rigid plate having a belt receiving passage therethrough at a top end region and a convex region defining said partial spherical section at a lower end region of said plate.

6. A handgun carrier in accordance with claim 5 wherein said plate is curved to the generally conform to the shape of a belt when worn.

7. A handgun carrier in accordance with claim 5 wherein said plate is of sufficient thickness to receive a portion of said locking member.

8. A handgun carrier in accordance with claim 5 wherein said plate defines a concave partially spherical surface with a common axial line with said first and second partial spherical surfaces and a portion of said locking member engages said concave surface to lock said handgun carrier in any angular position selected by the wearer.

9. A handgun carrier in accordance with claim 5 wherein the partial spherical section of said plate defines a partial spherical convexo-concave section in which the partial spherical convex surface mates with a mating surface on said adjustable means and said partial spherical concave surface mates with said locking device.

10. A handgun carrier in accordance with claim 8 wherein the portion of the locking member engaging said concave surface is a captive nut and housing.

11. A handgun carrier in accordance with claim 1 wherein said belt loop assembly includes an elongated cylindrical spacer means positioned between said body and said belt loop defining means and one cylindrical end of said spacer engaged the partial cylindrical section of said belt loop assembly.

12. A handgun carrier in accordance with claim 1 for carrying a handgun having a trigger and a trigger guard wherein one of said first an second partial spherical surfaces includes a shaped recess in its partial spherical surface and fastening means extending through said shaped recess wherein the difference in size of the recess and the portion of said fastening means extending into said recess defines the limits of spherical angle deflection of the first and second partial spherical surfaces and therefore the limit of spherical angle adjustment of said body with respect to said belt loop assembly.

13. A handgun carrier in accordance with claim 12 wherein said spacer includes a protrusion extending into the recess wherein the relative dimensions of said protrusion and recess size determine the extent of linear adjustment of said body with respect to said belt loop assembly.

14. A handgun carrier in accordance with claim 13 wherein said slot is elongated and said protrusion is a tenon shorter than said slot but of nearly the same width as said slot thereby allowing linear adjustment but preventing angular adjustment of said handgun carrier at said body.

15. A handgun carrier in accordance with claim 1 wherein said handgun holder comprises an elongated relatively rigid body having a barrel receiving surface and a trigger guard receiving recess.

16. A handgun carrier in accordance with claim 14 including a trigger guard locking member secured to said body and extending into said trigger guard receiving recess at a compound angle with respect to the axis defined by the barrel of a handgun in said carrier;

said compound angle being greater in a plane transverse parallel to said axis and lesser in the direction normal to said axis.

17. A handgun carrier comprising:

a belt loop assembly;

a handgun holder secured to said belt loop assembly;

said belt loop assembly including means defining a belt loop dimensioned to receive a waist worn belt to suspend the handgun carrier and a handgun holder attachment means;

said handgun holder attachment means including a first partial spherical surface and a second partial spherical surface mating with said first partial spherical surface;

one of said surfaces secured to said belt loop assembly and the other of said surface secured to said handgun holder; and adjustable means for engaging said first and second partial spherical surfaces for spherical angular adjustment between the belt loop assembly and the handgun holder.

wherein one of said first and second partial spherical surfaces includes a shaped recess in its partial spherical surface and said fastening means extends through said shaped recess wherein the difference in size of the recess and the portion of said fastening means extending into said recess defines the limits of spherical angle deflection of the first and second partial spherical surfaces and therefore the limit of spherical angle adjustment of said body with respect to said belt loop assembly;

wherein said spacer includes a protrusion extending into the recess wherein the relative dimensions of said protrusion and slot size determine the extent of linear adjustment of said body with respect to said belt loop assembly;

said slot is elongated and said protrusion is a tenon shorter than said slot but of nearly the same width as said slot thereby allowing linear adjustment but preventing angular adjustment of said handgun carrier at said body;

a trigger guard locking member secured to said body and extending into said trigger guard receiving recess at a compound angle with respect to the axis defined by the barrel of a handgun in said carrier;

said compound angle being greater in a plane transverse parallel to said axis and lesser in the direction normal to said axis; and wherein said compound angle ranges from 15 to 40 degrees with respect to the said axis in the parallel plane and from 5 to 15 degrees with respect to the direction normal to the axis.

18. A handgun carrier comprising:

a belt loop assembly;

a handgun holder secured to said belt loop assembly;

said belt loop assembly including means defining a belt loop dimensioned to receive a waist worn belt to suspend the handgun carrier and a handgun holder attachment means;

said handgun holder attachment means including a first partial spherical surface and a second partial spherical surface mating with said first partial spherical surface;

one of said surfaces secured to said belt loop assembly and the other of said surface secured to said handgun holder;

adjustable means for engaging said first and second partial spherical surfaces for spherical angular adjustment between the belt loop assembly and the handgun holder;

said handgun holder comprises an elongated relatively rigid body having a barrel receiving surface and a trigger guard receiving recess; and trigger guard locking means comprising a locking bar with one end rotatably secured to said body and a second end cantilevered into said trigger guard receiving axis and including means for adjusting the extent of entrance of said second end of said locking bar into said trigger guard recess.

19. A handgun carrier comprising:

a belt loop assembly;

a handgun holder secured to said belt loop assembly;

said belt loop assembly including means defining a belt loop dimensioned to receive a waist worn belt to suspend the handgun carrier and a handgun holder attachment means;

said handgun holder attachment means including a first partial spherical surface and a second partial spherical surface mating with said first partial spherical surface;

one of said surfaces secured to said belt loop assembly and the other of said surface secured to said handgun holder;

adjustable means for engaging said first and second partial spherical surfaces for spherical angular adjustment between the belt loop assembly and the handgun holder;

said handgun holder comprises an elongated relatively rigid body having a barrel receiving surface and a trigger guard receiving recess;

wherein said trigger guard locking means comprises a locking bar with one end rotatably secured to said body and a second end cantilevered into said trigger guard receiving axis and including means for adjusting the extent of entrance of said second end of said locking bar into said trigger guard recess;

wherein said adjusting means is accessible to the wearer between the body and the belt loop assembly to allow adjustment of the restraint upon withdrawing of a handgun from the carrier while the handgun carrier is being worn.

20. A handgun carrier for carrying a handgun with a trigger and a trigger guard comprising:

a belt loop assembly;

a handgun holder secured to said belt loop assembly;

said belt loop assembly including means defining a belt loop dimensioned to receive a waist worn belt to suspend the handgun carrier and a handgun holder attachment means;

said handgun holder attachment means including a first partial spherical surface and a second partial spherical surface mating with said first partial spherical surface;

one of said surfaces secured to said belt loop assembly and the other of said surface secured to said handgun holder;

adjustable means for engaging said first and second partial spherical surfaces for spherical angular adjustment between the belt loop assembly and the handgun holder;

said handgun holder comprises an elongated relatively rigid body having a barrel receiving surface and a trigger guard receiving recess;

wherein said trigger guard locking means comprises a locking bar with one end rotatably secured to said body and a second end cantilevered into said trigger guard receiving axis and including means for adjusting the extent of entrance of said second end of said locking bar into said trigger guard recess;

wherein said adjusting means is accessible to the wearer between the body and the belt loop assembly to allow adjustment of the restraint upon withdrawing of a handgun from the carrier while the handgun carrier is being worn;

wherein said locking bar includes a contoured surface with the end thereof adapted to extend into the trigger guard in the region ahead of the trigger of the handgun carried in the handgun carrier.

21. A handgun carrier for holding a handgun and adjustable by a wearer while being worn comprising:

a belt loop assembly;

a handgun holder secured to said belt loop assembly;

said belt loom assembly including means defining a belt loop dimensioned to receive a waist worn belt to suspend the handgun carrier and a handgun holder attachment means;

said handgun holder attachment means including a first partial spherical surface and a second partial spherical surface mating with said first partial spherical surface;

one of said surfaces secured to said belt loop assembly and the other of said surface secured to said handgun holder;

adjustable means for engaging said first and second partial spherical surfaces for spherical angular adjustment between the belt loop assembly and the handgun holder;

said handgun holder comprises an elongated relatively rigid body having a barrel receiving surface and a trigger guard receiving recess;

wherein said trigger guard locking means comprises a locking bar with one end rotatably secured to said body and a second end cantilevered into said trigger guard receiving axis and including means for adjusting the extent of entrance of said second end of said locking bar into said trigger guard recess;

wherein said adjusting means is accessible to the wearer between the body and the belt loop assembly to allow adjustment of the restraint upon withdrawing of a handgun from the carrier while the handgun carrier is being worn;

wherein said locking bar includes a contoured surface with the end thereof extending into the trigger guard in the region ahead of the trigger of the handgun carried in the handgun carrier;

including stop means engaging the trigger guard of a handgun carried in said carrier to limit the forward direction of inserting the handgun into said carrier to prevent said locking bar form engaging the trigger at any position of adjustment.

22. A handgun carrier comprising:

a belt loop assembly for mounting the carrier on a wearer's belt;

a carrier body comprising an elongated relatively rigid body defining a handgun frame supporting surface having a trigger guard receiving recess therein;

a trigger guard retaining locking bar mounted on said body and including one end cantilevered into said trigger guard receiving recess; and said trigger guard retaining locking bar being resiliently mounted for pivotal deflection to allow the entrance and removal of the trigger guard from said trigger guard receiving recess.

23. A handgun carrier in accordance with claim 22 wherein said locking bar is mounted on said body at one side of said trigger guard receiving recess and included adjustment means accessible to the wearer while the handgun carrier is being worn.

24. A handgun carrier for carrying on a wearer's belt including:

a belt loop assembly for mounting the carrier on a wearer's belt;

a carrier body comprising an elongated relatively rigid body defining a handgun frame supporting surface having a trigger guard receiving recess therein;

a trigger guard retaining locking bar mounted on said body and including one end cantilevered into said trigger guard receiving recess;

said trigger guard retaining locking bar being resiliently mounted for deflection to allow the entrance and removal of the trigger guard from said trigger guard receiving recess;

said locking bar is mounted on said body at one side of said trigger guard receiving recess and included adjustment means accessible to the wearer while the handgun carrier is being worn;

wherein said locking bar is secured to said body to enter the trigger guard recess at a compound angle with respect to an axis defined by the handgun barrel carried in said carrier; and the compound angle being between 15 and 40 degrees in a direction transverse with respect to the length of the body and between 5 and 15 degrees normal to the body.

25. A handgun carrier for carrying on a wearer's belt comprising:

a belt loop assembly for mounting the carrier on a wearer's belt;

a carrier body comprising an elongated relatively rigid body defining a handgun frame supporting surface having a trigger guard receiving recess therein;

a trigger guard retaining locking bar mounted on said body and including one end cantilevered into said trigger guard receiving recess;

said trigger guard retaining locking bar being resiliently mounted for deflection to allow the entrance and removal of the trigger guard from said trigger guard receiving recess;

wherein said body includes a generally circular cross section recess in one face thereof and said locking bar includes a generally circular cross section protrusion thereon, said protrusion resting in said generally circular cross section recess and wherein said locking bar is pivotal about said protrusion to adjust the degree of entrance of said locking bar into the trigger guard recess of said body.

26. A handgun carrier in accordance with claim 22 wherein said locking bar is secured to said body by spring biasing means.

27. A handgun carrier in accordance with claim 26 wherein said spring biasing means comprises a spring on an adjusting screw bearing against said locking bar whereby said locking bar is adjustable in resistance to deflection upon entrance of a handgun trigger guard.

28. A handgun carrier for carrying on a wearer's belt comprising:

a belt loop assembly for mounting the carrier on a wearer's belt;

a carrier body comprising an elongated relatively rigid body defining a handgun frame supporting surface having a trigger guard receiving recess therein;

a trigger guard retaining locking bar mounted on said body and including one end cantilevered into said trigger guard receiving recess;

said trigger guard retaining locking bar being resiliently mounted for deflection to allow the entrance and removal of the trigger guard from said trigger guard receiving recess;

said locking bar is secured to said body by spring biasing means;

wherein said spring biasing means comprises a spring on an adjusting screw bearing against said locking bar whereby said locking bar is adjustable in both resistance to deflection upon entrance of a handgun trigger guard;

wherein said adjusting screw has a head located on one face of said body and accessible to the wearer of the handgun carrier while being worn.

29. A handgun carrier for handguns having a barrel and trigger guard comprising:

a belt loop assembly;

a handgun holder secured to said belt loop assembly;

said handgun holder comprising a relatively rigid elongated body having a trigger guard receiving end and a barrel receiving end and defining a surface including longitudinally spaced side edges for receiving the barrel of the handgun and a trigger guard recess for receiving said trigger guard;

barrel securing means secured to said body comprising an inverted J shaped bracket extending from one of said side edges at said barrel receiving end of said body to overlie said surface and defining an area between said bracket and surface to receive said barrel in secured relationship to said surface; and means adjustable securing said bracket to said body.

30. A holster comprising an elongated body including a barrel end region cradle having a bottom surface and defining a trigger guard recess, the bottom surface of said barrel end region cradle and trigger guard recess constituting the primary support for a handgun positioned therein and an inverted J shaped retainer extending over the barrel end region of the handgun without enclosing the muzzle of the handgun.

31. A holster in accordance with claim 30 wherein said body includes an integral stop for limiting the forward movement of a handgun carried in the holster.

32. A holster in accordance with claim 31 intended for carrying revolvers including a cylinder having a front face wherein said stop is an extension of said body engaging the face of a cylinder of a revolver carried in said holster.

* * * * *